US009033446B2

(12) United States Patent
Sakano

(10) Patent No.: US 9,033,446 B2
(45) Date of Patent: May 19, 2015

(54) LIQUID JETTING APPARATUS

(71) Applicant: BROTHER KOGYO KABUSHIKI KAISHA, Nagoya-shi, Aichi-ken (JP)

(72) Inventor: Yuji Sakano, Toyota (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/851,881

(22) Filed: Mar. 27, 2013

(65) Prior Publication Data

US 2013/0321509 A1 Dec. 5, 2013

(30) Foreign Application Priority Data

May 31, 2012 (JP) ..... 2012-124496

(51) Int. Cl.
*B41J 29/38* (2006.01)
*B41J 2/165* (2006.01)
*B41J 11/00* (2006.01)

(52) U.S. Cl.
CPC ..... *B41J 2/16535* (2013.01); *B41J 11/0015* (2013.01)

(58) Field of Classification Search
USPC ..... 347/5, 9, 16, 19
See application file for complete search history.

(56) References Cited

U.S. PATENT DOCUMENTS 7,731,322 B2 * 6/2010 Kogure et al. ..... 347/16

FOREIGN PATENT DOCUMENTS

| | | |
|---|---|---|
| JP | H07-117889 A | 5/1995 |
| JP | H08-073072 A | 3/1996 |
| JP | 2006-058792 A | 3/2006 |

* cited by examiner

*Primary Examiner* — Lam Nguyen
(74) *Attorney, Agent, or Firm* — Merchant & Gould PC

(57) ABSTRACT

A liquid jetting apparatus includes: a jetting section having a plurality of jetting ports for jetting a liquid; a transport section configured to transport the recording medium along a transport pass having a facing area which faces the plurality of jetting ports; a charging section arranged on an upstream side of the facing area in a transport direction in which the recording medium is transported by the transport section, and configured to charge the recording medium; a charged-area determining section configured to determine a non-landing area, of the recording medium, in which the liquid jetted from the plurality of jetting ports is not landed in a case that the recording medium is disposed at the facing area, as a charged area; and a controller configured to control the charging section to charge the charged area determined by the charged-area determining section.

3 Claims, 12 Drawing Sheets

LIQUID JETTING APPARATUS

CROSS REFERENCE TO RELATED APPLICATION

The present application claims priority from Japanese Patent Application No. 2012-124496, filed on May 31, 2012, the disclosure of which is incorporated herein by reference in its entirety.

BACKGROUND OF THE INVENTION

1. Field of the Invention

The present invention relates to a liquid jetting apparatus which jets a liquid to a recording medium.

2. Description of the Related Art

In the known technique, a cleaning member is transported in a state of being electrically charged in an image forming apparatus, and foreign matters in the apparatus is removed by being adsorbed to the cleaning member.

In the technique described above, an exclusive member as the cleaning member is required, and thus there is a cost disadvantage.

SUMMARY OF THE INVENTION

Thus, the inventor of the present teaching has considered that foreign matters in a liquid jetting apparatus are removed by using a recording medium in the apparatus. As a result, the inventor has found out that accuracy of landing of liquid may be decreased in a case that the liquid is landed on an electrically-charged area of the recording medium.

According to an aspect of the present teaching, there is provided a liquid jetting apparatus configured to jet a liquid on a recording medium, including: a jetting section including a plurality of jetting ports for jetting the liquid; a transport section configured to transport the recording medium along a transport pass having a facing area which faces the plurality of jetting ports; a charging section arranged on an upstream side of the facing area in a transport direction in which the recording medium is transported by the transport section, and configured to charge the recording medium; a charged-area determining section configured to determine a non-landing area, of the recording medium, in which the liquid jetted from the plurality of jetting ports is not landed in a case that the recording medium is disposed at the facing area, as a charged area; and a controller configured to control the charging section to charge the charged area determined by the charged-area determining section.

From the viewpoint as described above, the recording medium is used to remove the foreign matters in the apparatus, and thus an exclusive member for removing the foreign matters is not required. Further, instead of charging any area in the recording medium, the non-landing area of the recording medium, in which no liquid is landed, is charged, and thereby making it possible to suppress decrease in accuracy of landing of liquid. By transporting the recording medium in a state of being electrically charged, the foreign matters in the apparatus are adsorbed to the charged area of the recording medium. Therefore, according to the viewpoint as described above, it is possible to remove the foreign matters in the apparatus while suppressing the decrease in accuracy of landing of liquid, without providing the exclusive member.

DESCRIPTION OF THE EMBODIMENTS

Figure 1:
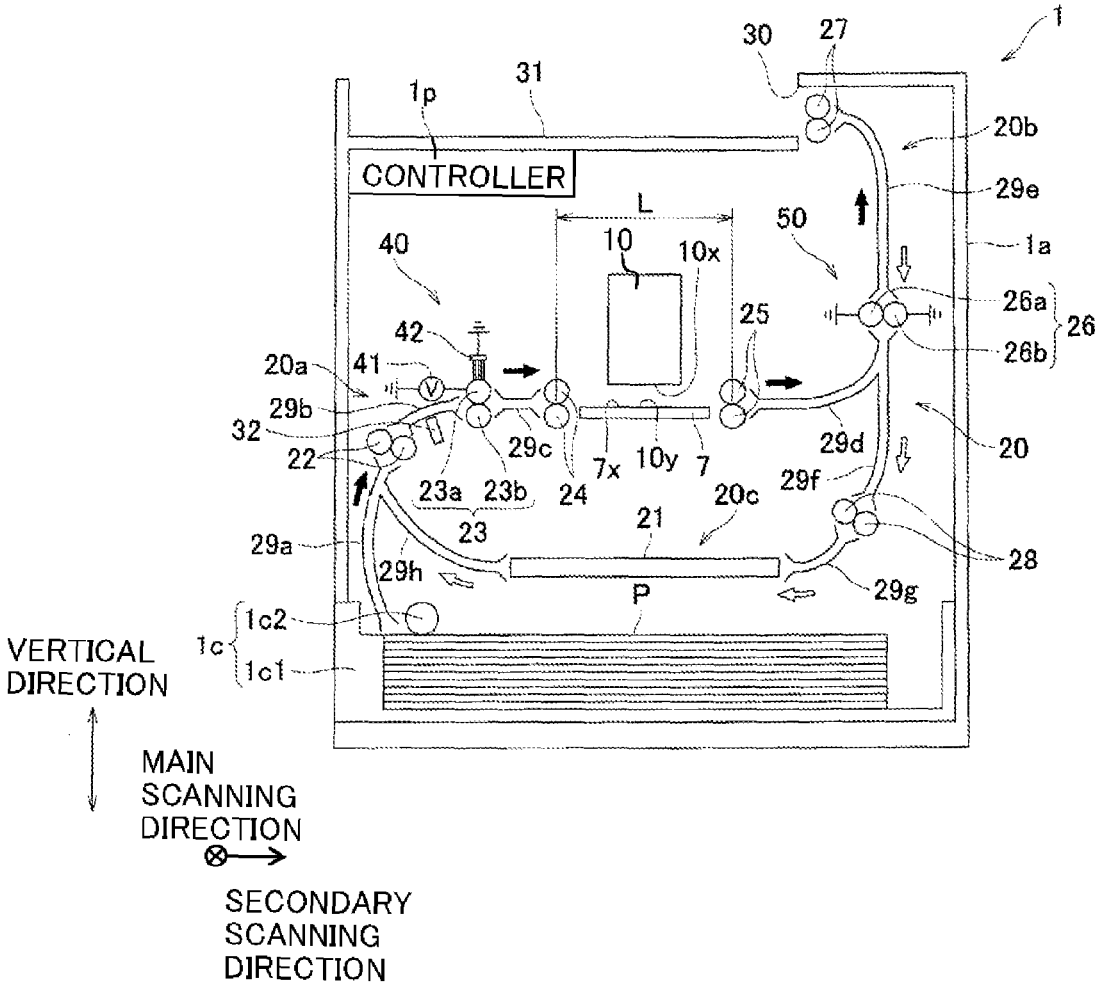
FIG. 1 is a schematic side view showing an internal structure of an ink-jet printer according to the first embodiment of the present teaching.

Hereinbelow, referring to the accompanying drawings, preferred embodiments of the present teaching will be explained.

First, referring to FIG. 1, explanations will be made with respect to an overall construction of an ink-jet printer 1 according to the first embodiment of the present teaching.

The printer 1 has a box-shaped casing 1*a*. A paper discharge section 31 is provided at the upper side of the top panel of the casing 1*a*. In the inner space of the casing 1*a*, a head 10, a platen 7 (an example of a support member), a paper sensor 32, a controller 1*p* (an example of a controller), a transport section 20, a paper feed unit 1*c*, and the like are accommodated. In the inner space of the casing 1*a*, a transport pass through which a paper sheet P is transported is formed from the paper feed unit 1*c* to the paper discharge section 31 along thick arrows shown in FIG. 1. Further, in the casing 1*a*, a cartridge (not shown) containing a black ink to be supplied to the head 10 is provided removably. The cartridge is connected to the head 10 via a tube etc., and the ink is supplied to the head 10.

The head 10 is a line head having a substantially boxed-shape elongated in a main scanning direction (direction perpendicular to the sheet surface of FIG. 1). A plurality of jetting ports 14*a* is open on the lower surface (jetting surface 10*x*) of the head 10 (see FIG. 3 and FIG. 4). The head 10 is supported by the casing 1*a* via a holder (not shown). The holder supports the head 10 such that a predetermined interspace suitable for recording is formed between the jetting surface 10*x* and the surface (support surface) 7*x* of the platen 7.

Figure 5A:
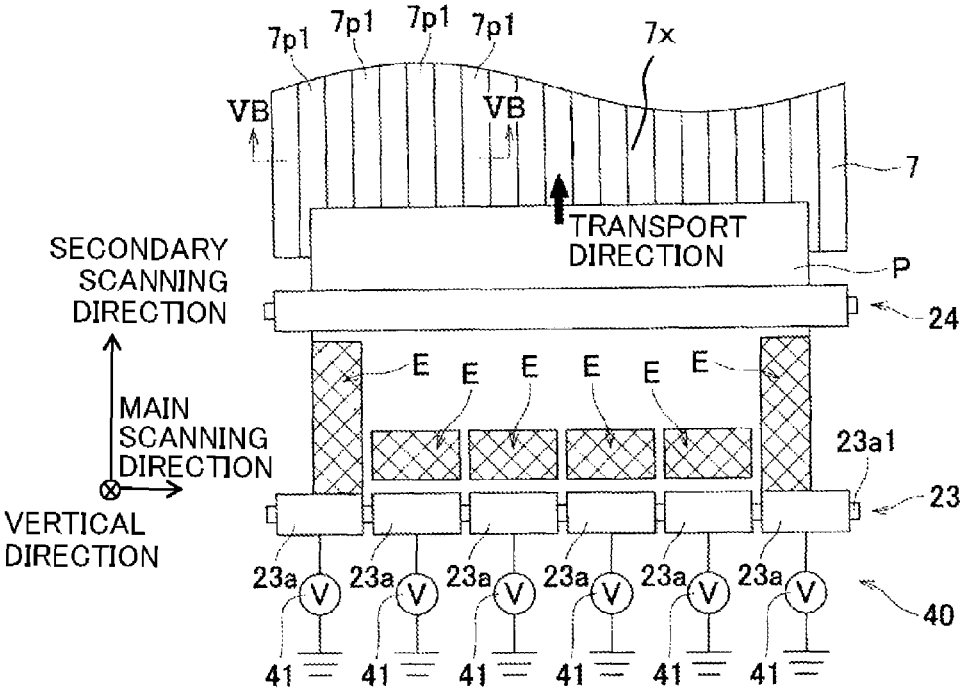
FIG. 5A is a plan view for explaining a charged area of a paper sheet and a structure of a platen and a charging section.
Figure 5B:
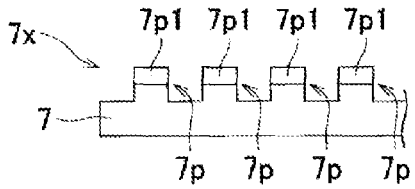
FIG. 5B is a cross-sectional view taken along the line VB-VB of FIG. 5A.

The platen 7 is a flat plate-shaped member and is arranged at a position facing the jetting surface 10*x*. As shown in FIGS. 5A and 5B, a plurality of bumps 7*p* are formed in the support surface 7*x* of the platen 7. The bumps 7*p* extend in a secondary scanning direction respectively, and are formed in the main scanning direction at regular intervals. Front end portions 7p1 of the bumps 7p of the platen 7, which are portions making contact with the paper sheet P, are made of a conductive material such as a metal, and portions other than the front end portions 7p1 are made of a resin. Noted that, the platen 7 may be formed entirely of the conductive material without being limited to the structure in which only the front end portions 7p1 are made of the conductive material.

The transport section 20 includes an upstream transport section 20a (an example of a first transport section), a downstream transport section 20b (an example of a second transport section), and a re-transport section 20c. The upstream transport section 20a and the downstream transport section 20b are disposed to sandwich the platen 7. The upstream transport section 20a is arranged on the upstream side of the platen 7 in a transport direction (transport direction of the paper sheet P by the transport section 20) and the downstream transport section 20b is disposed on the downstream side of the platen 7 in the transport direction. The upstream transport section 20a transports the paper sheet P toward a facing area 10y of the support surface 7x facing the jetting surface 10x so that a surface (first surface) of the paper sheet P (surface which faces downward in a paper feed tray 1c1) faces the jetting surface 10x. The downstream transport section 20b and the re-transport section 20c transport the paper sheet P having an image recorded on the surface thereof toward the facing area 10y so that a back surface (second surface) on the side opposite to the surface of the paper sheet P faces the jetting surface 10x.

The upstream transport section 20a includes pairs of rollers 22 to 24 and guides 29a to 29c. The downstream transport section 20b includes pairs of rollers 25 to 27 and guides 29d and 29e. The re-transport section 20c includes a re-transport cassette 21, a pair of rollers 28, and guides 29f to 29h.

Figure 6:
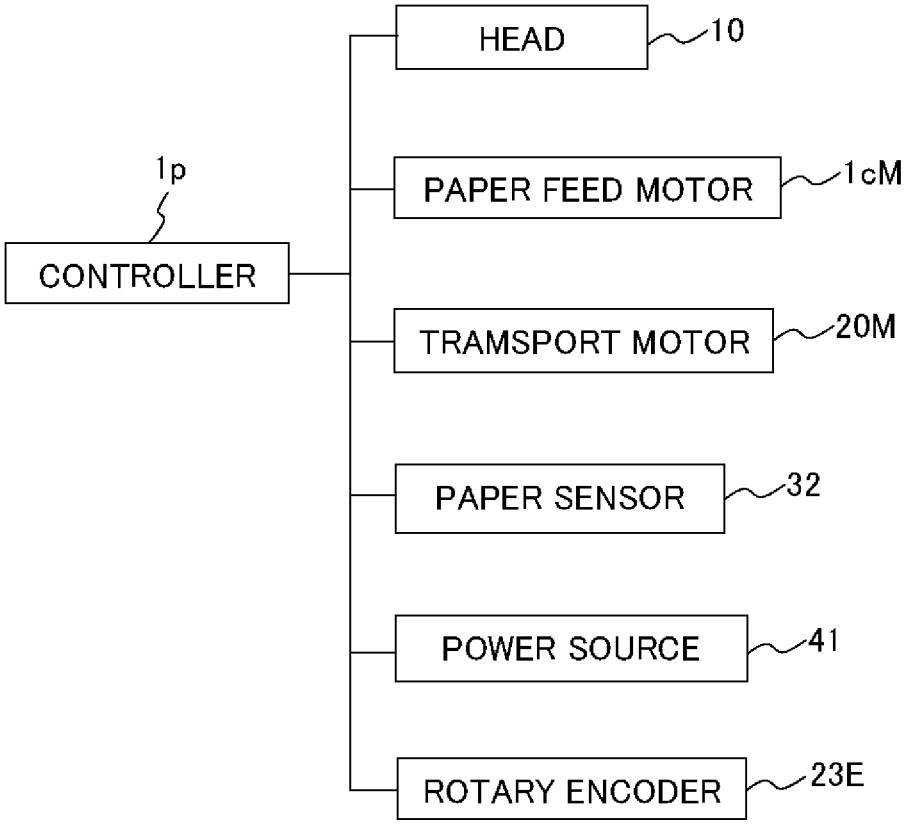
FIG. 6 is a block diagram showing an electrical construction of the printer.

The pairs of rollers 22 to 28 are arranged in the transport pass at appropriate intervals. Here, the pair of rollers 24 is disposed on the upstream side of the facing area 10y in the transport direction. The pair of rollers 25 is disposed on the downstream side of the facing area 10y in the transport direction. Further, as shown in FIG. 1, the pair of rollers 25 is arranged at a position separated by a distance L from the pair of rollers 24 in the transport direction. The distance L is made to be a distance shorter than the length of the paper sheet P in the transport direction. That is, in a case that the paper sheet P is transported via the facing area 10y, the paper sheet P is initially transported in a state that the pair of transport rollers 24 nips the paper sheet P and the pair of transport rollers 25 does not nip the paper sheet P. Then, in a case that the front end of the paper sheet P in the transport direction arrives at the pair of rollers 25, the paper sheet P is transported in a state of being nipped by the pair of rollers 24 and the pair of rollers 25. Thereafter, in a case that the rear end of the paper sheet P in the transport direction has passed the pair of rollers 24, the paper sheet P is transported in a state that the pair of rollers 24 does not nip the paper sheet P and the pair of rollers 25 nips the paper sheet P. One roller of the rollers, of each of the pairs of rollers 22 to 28, is a driving roller which is driven by a transport motor 20M (see FIG. 6) to rotate under control of the controller 1p. The other roller of the rollers, of each of the pairs of rollers 22 to 28, is a driven roller which rotates accompanying with the rotation of the one roller. The one roller and the other roller, of each of the pairs of rollers 22 to 28, rotate in directions different from each other while nipping the paper sheet P. Accordingly, the paper sheet P is transported in the transport direction. Each of the guides 29a to 29h is formed of a pair of plates arranged to be separated mutually in a plane direction. The re-transport cassette 21 is disposed above the paper feed tray 1c1 and below the platen 7 to define a space through which the paper sheet P can pass.

The paper feed unit 1c includes the paper feed tray 1c1 and a paper feed roller 1c2. The paper feed tray 1c1 is removable with respect to the casing 1a. The paper feed tray 1c1 is a box, the upper surface of which is open. A plurality of paper sheets P can be accommodated in the paper feed tray 1c1. The paper feed roller 1c2 is driven by a paper feed motor 1cM (see FIG. 6) to rotate under the control of the controller 1p, and thereby feeding the paper sheet P positioned uppermost in the paper feed tray 1c1.

The controller 1p includes a Central Processing Unit (CPU) which is a computation processing device. In addition to that, the controller 1p includes a Read Only Memory (ROM), a Random Access Memory (RAM) including a non-volatile RAM, an Application Specific Integrated Circuit (ASIC), an Interface (I/F), an Input/Output Port (I/O), and the like. The ROM stores programs to be executed by the CPU, various fixed data, and the like. The RAM temporarily stores data needed for executing the programs (image data and the like). The ASIC carries out rewriting, sorting, and the like for the image data (for example, signal processing and image processing). The I/F carries out data transmission and data reception with an external device (PC etc., connected to the printer 1). The I/O carries out input/output of detection signals of various sensors. Note that, it is allowable that the controller 1p does not include the ASIC and that the rewriting, sorting, and the like for the image data are executed by the programs etc., executed by the CPU.

The controller 1p controls the head 10 and the transport section 20, based on a recording command supplied from the external device, so that the image is recorded on the paper sheet P. In other words, the controller 1p controls a transport operation of the paper sheet P by the transport section 20 and an ink jetting operation by the head 10 synchronized with transport of the paper sheet P.

The paper sheet P fed from the paper feed unit 1c is transported by the transport sections 20a and 20b along black arrows in FIG. 1 under the control of the controller 1p. In a case that the paper sheet P passes through directly below the head 10 while being supported by the support surface 7x in the facing area 10y, the head 10 is driven by the control of the controller 1p to jet the ink from each of the jetting ports 14a (see FIG. 4) toward the surface of the paper sheet P. Accordingly, the image is recorded on the surface of the paper sheet P. The ink jetting operation from each of the jetting ports 14a is executed based on a detection signal from the paper sensor 32 which detects the front end of the paper sheet P. Thereafter, the paper sheet P is discharged on the paper discharge section 31 from an opening 30 formed at the upper portion of the casing 1a, in a case that single-sided recording in which the image is recorded on one surface of the paper sheet P is performed. In a case that double-sided printing in which the image is recorded on both surfaces of the paper sheet P is performed, the controller 1p reverses a rotation direction of the pairs of rollers 26 and 27 when the paper sheet P is nipped by the pair of rollers 27. Accordingly, the paper sheet P is fed to the re-transport section 20c along white arrows in FIG. 1. Then, the paper sheet P is transported by the transport sections 20a and 20b again along the black arrows of FIG. 1 and the image is recorded on the back surface when the paper sheet P passes through directly below the head 10. Thereafter, the paper sheet P is discharged onto the paper discharge section 31 from the opening 30. The commands for the single-sided recording and the double-sided recording are included in the recording command.

Of the components included in the transport section 20, the pair of rollers 23 forms a charging section 40 and the pair of rollers 26 forms a foreign substance elimination section 50. The charging section 40 and the foreign substance elimination section 50 will be explained later in detail.

Figure 3:
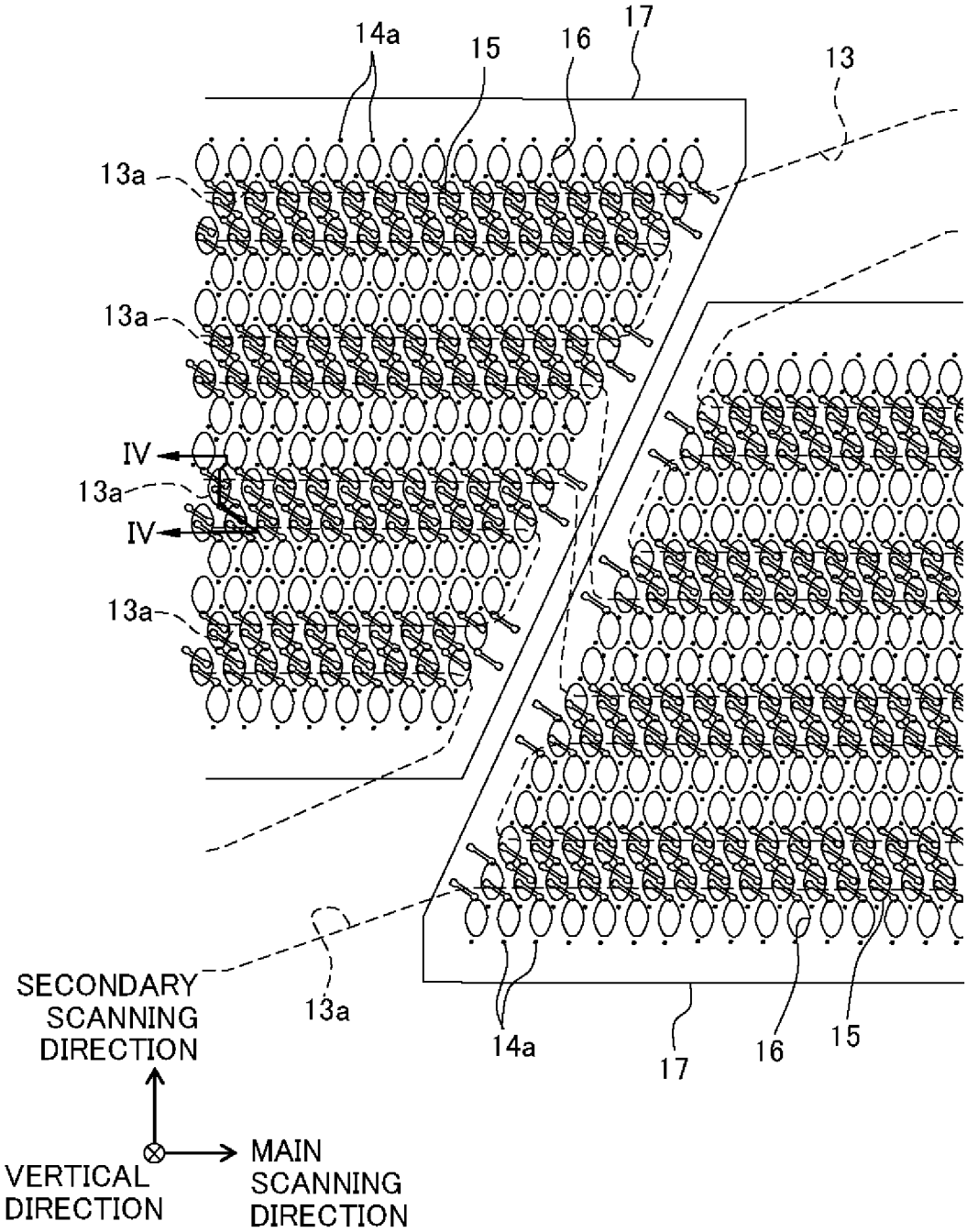
FIG. 3 is a partial enlarged view showing the region III surrounded by chain line in FIG. 2.
Figure 4:
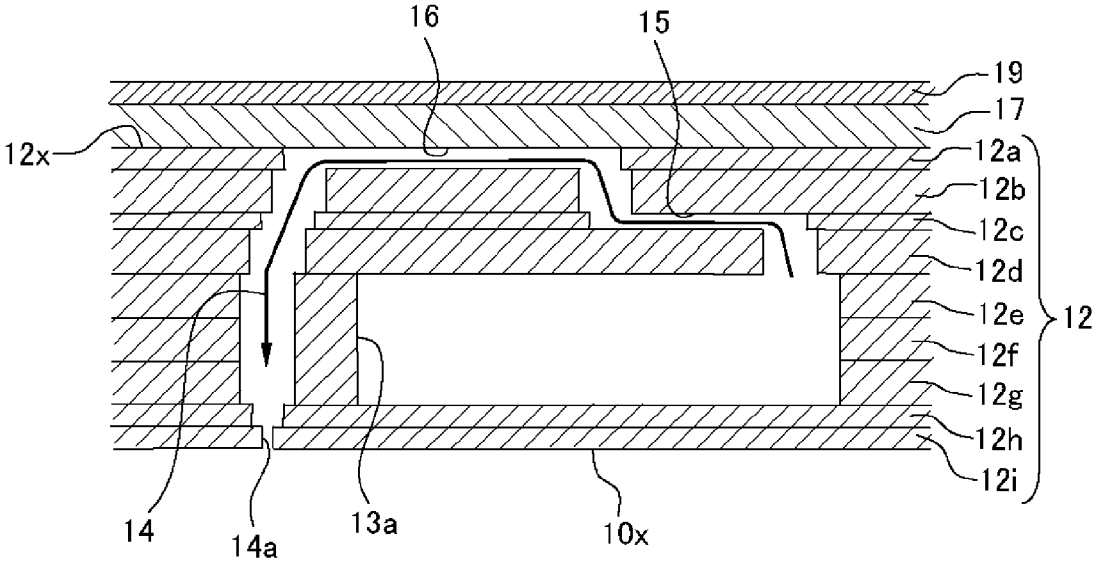
FIG. 4 is a cross-sectional view taken along the line IV-IV of FIG. 3.

Subsequently, an explanation will be made about a structure of the head 10 with reference to FIG. 2 to FIG. 4. FIG. 3 shows pressure chambers 16 and apertures 15 disposed below actuator units 17 with solid lines which should have been dotted lines.

The head 10 includes a channel unit 12, a reservoir unit, eight actuator units 17, eight FPCs (flexible flat boards) 19, a circuit board, and the like.

The channel unit 12 is a stacked body in which nine metallic plates 12*a*, 12*b*, 12*c*, 12*d*, 12*e*, 12*f*, 12*g*, 12*h*, and 12*i*, which are rectangular plates of almost the same size, are stacked. Channels are formed in the channel unit 12. Each of the channels includes a manifold channel 13, secondary manifold channels 13*a*, and individual channels 14. An Opening 12*y* is formed on an upper surface 12*x* of the channel unit 12. The manifold channel 13 is a channel having the opening 12*y* at one end. Each of the secondary manifold channels 13*a* is a channel branched from the manifold channel 13. Each of the individual channels 14 is a channel which is provided for one jetting port 14*a* and ranges from an exit of the secondary manifold channel 13*a* via the aperture 15 as a throttle for adjusting resistance in the channel and the pressure chamber 16, to arrive at the jetting port 14*a*. The lower surface of the channel unit 12 on the side opposite to the upper surface 12*x* is the jetting surface 10*x*. At least the metallic plate 12*i*, of the metallic plates 12*a* to 12*i* forming the channel unit 12, is preferably grounded.

The pressure chamber 16 is provided in each jetting port 14*a*. Each of the pressure chambers 16 is connected to one of the jetting ports 14*a*. The opening of each of the pressure chambers 16 has a substantially rhombic shape, and the pressure chambers 16 are arranged in a matrix form, in a fixed area of each of the actuator units 17 in the upper surface 12*x* (see FIG. 3). The jetting ports 14*a* are arranged in the matrix form, in an arrangement pattern which is the same as that of the pressure chambers 16, in an area facing the fixed area of each of the actuator units 17 in the lower surface (jetting surface 10*x*).

A channel including a reservoir is formed in the reservoir unit. The reservoir temporarily stores the ink supplied from the cartridge. One end of the channel is connected to the cartridge via the tube etc., and the other end of the channel is connected to the channel of the channel unit 12. The lower surface of the reservoir unit is formed with a recess and a protrusion. The protrusion is fixed to an area, of the upper surface 12*x* of the channel unit 12, which does not overlap with the actuator 17 (area surrounded by two-dot lines including the opening 12*y* shown in FIG. 2). The end portion of the channel is open on the front end surface of the protrusion (surface fixed to the upper surface 12*x*). The recess faces the upper surface 12*x* of the channel unit 12, the surface of the actuator unit 17, and the surface of the FPC 19 such that a small gap is provided between the recess and the upper surface 12*x*, the surface of the actuator unit 17, and the surface of the FPC 19.

Figure 2:
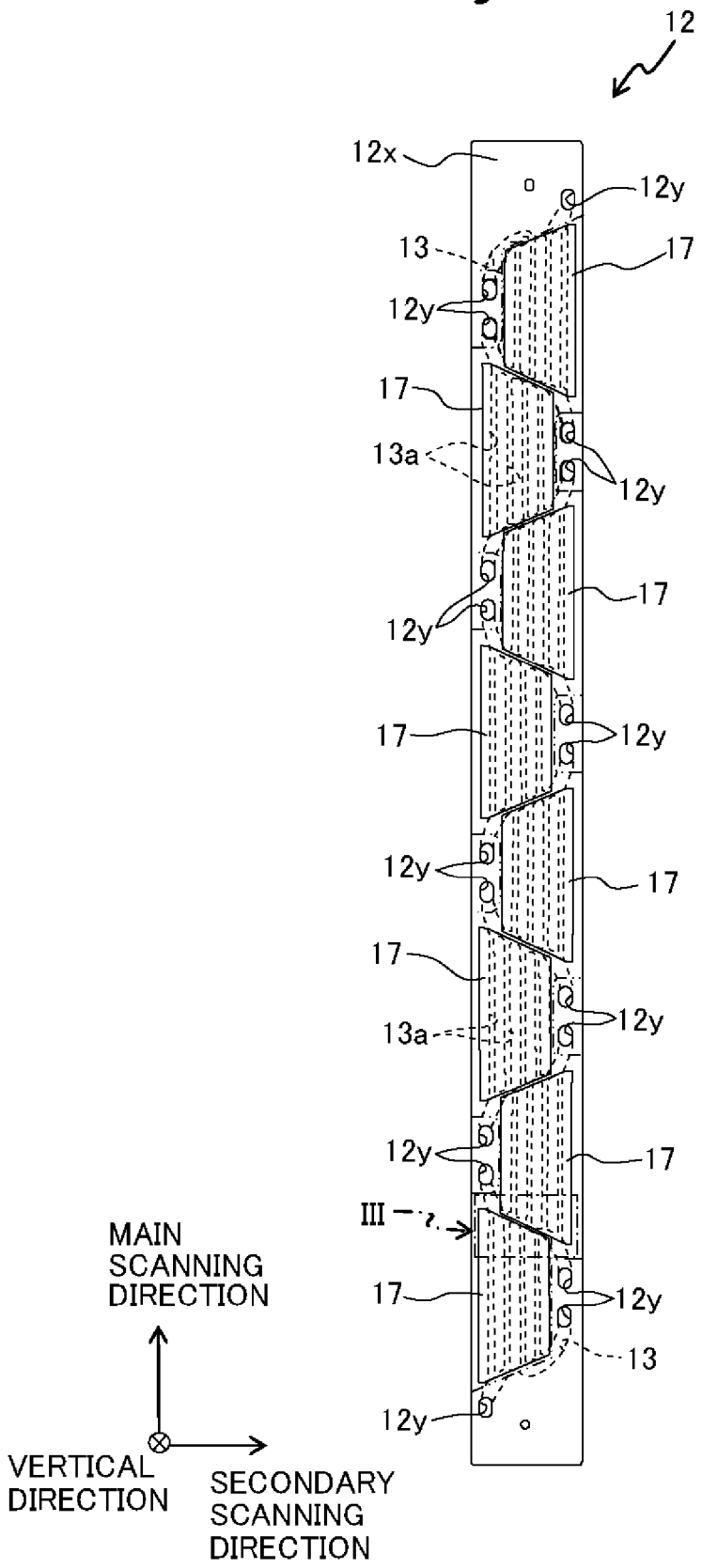
FIG. 2 is a plan view showing a channel unit and actuator units of an ink-jet head.

As shown in FIG. 2, the eight actuator units 17 are arranged in two rows of a zigzag pattern along the main scanning direction, and are fixed to the upper surface 12*x*. Each of the actuator units 17 has a trapezoidal profile and covers openings of the pressure chambers 16 formed in the fixed area of each of the actuator units 17. Each of the actuator units 17 is constructed of a piezoelectric layer, a common electrode, and an individual electrode. The piezoelectric layer and the common electrode, of the members as described above, each have the trapezoidal shape having a size which defines the profile of each of the actuator units 17. Each of the individual electrode is provided for one pressure chamber 16 and is arranged on the upper surface of the piezoelectric layer at a position overlapping with the one pressure chamber 16 in the vertical direction. A part corresponding to the individual electrode of each of the actuator units 17 functions as one piezoelectric actuator. Each of the actuators is deformable independently by application of voltage via the FPC 19, causes the corresponding pressure chamber 16 to change in volume, and applies energy to the ink in the corresponding pressure chamber 16. Accordingly, the ink is jetted from each of the jetting ports 14*a*.

The eight FPCs 19 are connected to the eight actuator units 17, respectively. One end of each of the FPCs 19 is fixed to one of the actuator units 17; and the other end of each of the FPCs 19 is fixed to the circuit board. Each of the FPCs 19 has a terminal and wiring corresponding to the electrode of each of the actuator units 17, and a driver IC is installed at a half-way portion of each of the FPCs 19. The wiring is connected to an output terminal of the driver IC. The circuit board adjusts the signal inputted from the controller 1*p* and outputs the adjusted signal to the driver IC via the wiring of each of the FPCs 19. The driver IC converts the signal inputted from the circuit board to a driving signal and transmits the driving signal to the electrode of each of the actuator units 17 via the wiring of each of the FPCs 19.

Next, an explanation will be made about structures of the charging section 40 and the foreign substance elimination section 50.

The charging section 40 charges the paper sheet P and is arranged on the upstream side of the facing area 10*y* in the transport direction (see FIG. 1). The charging section 40 is constructed of the pair of rollers 23, a plurality of power supplies 41 (an example of a voltage applying section), and an electricity removal brush 42.

Figure 5C:
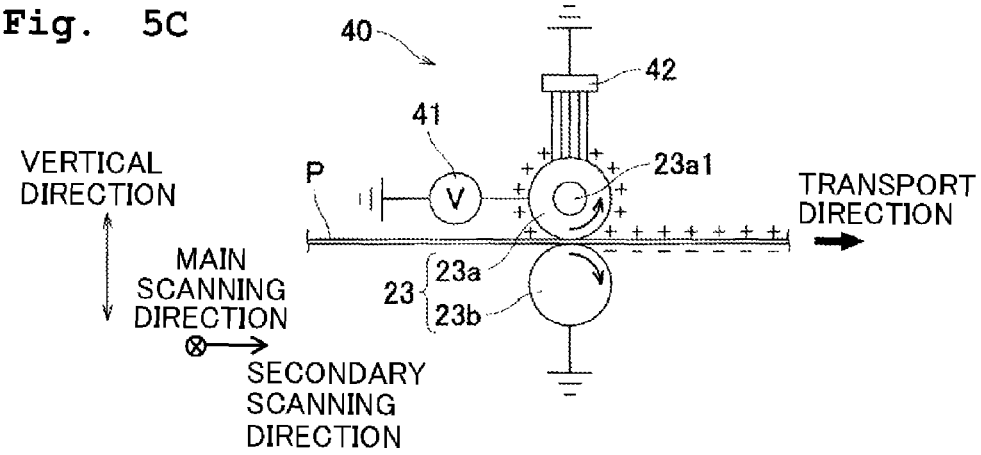
FIG. 5C schematically shows a charged aspect of the paper sheet by the charging section.

The pair of rollers 23 includes a plurality of rollers 23*a* (an example of a charging member and a contact member) and one roller 23*b*. The plurality of rollers 23*a* are attached to a rotational axis 23*a*1 extending in a direction perpendicular to the transport direction (main scanning direction). The plurality of rollers 23*a* are arranged to be separated from each other in the main scanning direction (see FIG. 5A). The rotational axis 23*a*1 is made of an insulating material such as resin, and each of the rollers 23*a* is made of a conductive material such as metal or a semiconductive material. The roller 23*b* extends in the main scanning direction to make contact with all of the rollers 23*a*. The roller 23*b* is grounded. The length of the roller 23*b* in the main scanning direction is longer than a width of the paper sheet P and is substantially the same as the total length of the rollers 23*a* in the main scanning direction. The rollers 23*a*, 23*b* rotate in directions different from each other with an axis along the main scanning direction as a rotation center, while nipping the paper sheet P (see FIG. 5C). Accordingly, the paper sheet P is transported in the transport direction.

The power sources 41 are provided for the rollers 23*a* respectively, as shown in FIG. 5A. Each of the power sources 41 applies the voltage to one of the rollers 23*a* to charge one of the rollers 23*a*. A positive terminal of each of the power sources 41 is connected to one of the rollers 23*a* and a negative terminal of each of the power sources 41 is grounded. Each of the power sources 41 incorporates an ON/OFF switch and the ON/OFF switch is switched by control of the controller 1*p*. Each of the power sources 41 applies positive voltage to one of the rollers 23*a* in a case that the ON/OFF switch is on. Each of the power sources 41 does not apply the voltage to one of the rollers 23*a* in a case that the ON/OFF switch is off.

The electricity removal brush 42 performs electricity removal of the rollers 23*a*. The electricity removal brush 42 is provided to make contact with all of the rollers 23*a*.

In a case that the paper sheet P is nipped by the pair of rollers 23 and that the voltage is applied to the rollers 23*a*, a portion, of the paper sheet P, which makes contact with the rollers 23*a* is charged. In this situation, a positive electrical charge is generated on a surface, of the paper sheet P, which makes contact with the rollers 23*a* and a negative electrical charge is generated on a surface, of the paper sheet P, on the side opposite to the surface making contact with the rollers 23*a* (see FIG. 5C). By transporting the paper sheet P in a state of being charged as described above, the foreign substance in the casing 1*a* (paper powder, dust, and the like) is adsorbed to a charged area E of the paper sheet P.

The foreign substance elimination section 50 removes the foreign matters attached to the paper sheet P, and is arranged in the downstream transport section 20*b* which is a part of the transport pass of the paper sheet P (see FIG. 1). The foreign substance elimination section 50 is constructed of the pair of rollers 26.

The pair of rollers 26 include grounded rollers 26*a* and 26*b* (examples of the ground member). Each of the grounded rollers 26*a* and 26*b* extends in the main scanning direction and has a length in the main scanning direction longer than the width of the paper sheet P. The rollers 26*a* and 26*b* rotate in directions different from each other with an axis along the main scanning direction as a rotation center, while nipping the paper sheet P. Accordingly, the paper sheet P is transported in the transport direction.

In a case that the paper sheet P is nipped by the pair of rollers 26 and that the rollers 26*a* and 26*b* make contact with the surface and the back surface of the paper sheet P respectively, the electrical charges on the surface and the back surface of the paper sheet P are removed and the electrical charges of the foreign substance attached to the paper sheet P are removed. In this situation, since the electrical charges on the surface and the back surface of the paper sheet P and the electrical charges of the foreign substance are removed, adsorption power of the foreign substance to the surface or the back surface of the paper sheet P is decreased, and the foreign substance is removed from the surface or the back surface of the paper sheet P. The removed foreign substance falls to the lower side of the casing 1*a*.

Figure 7:
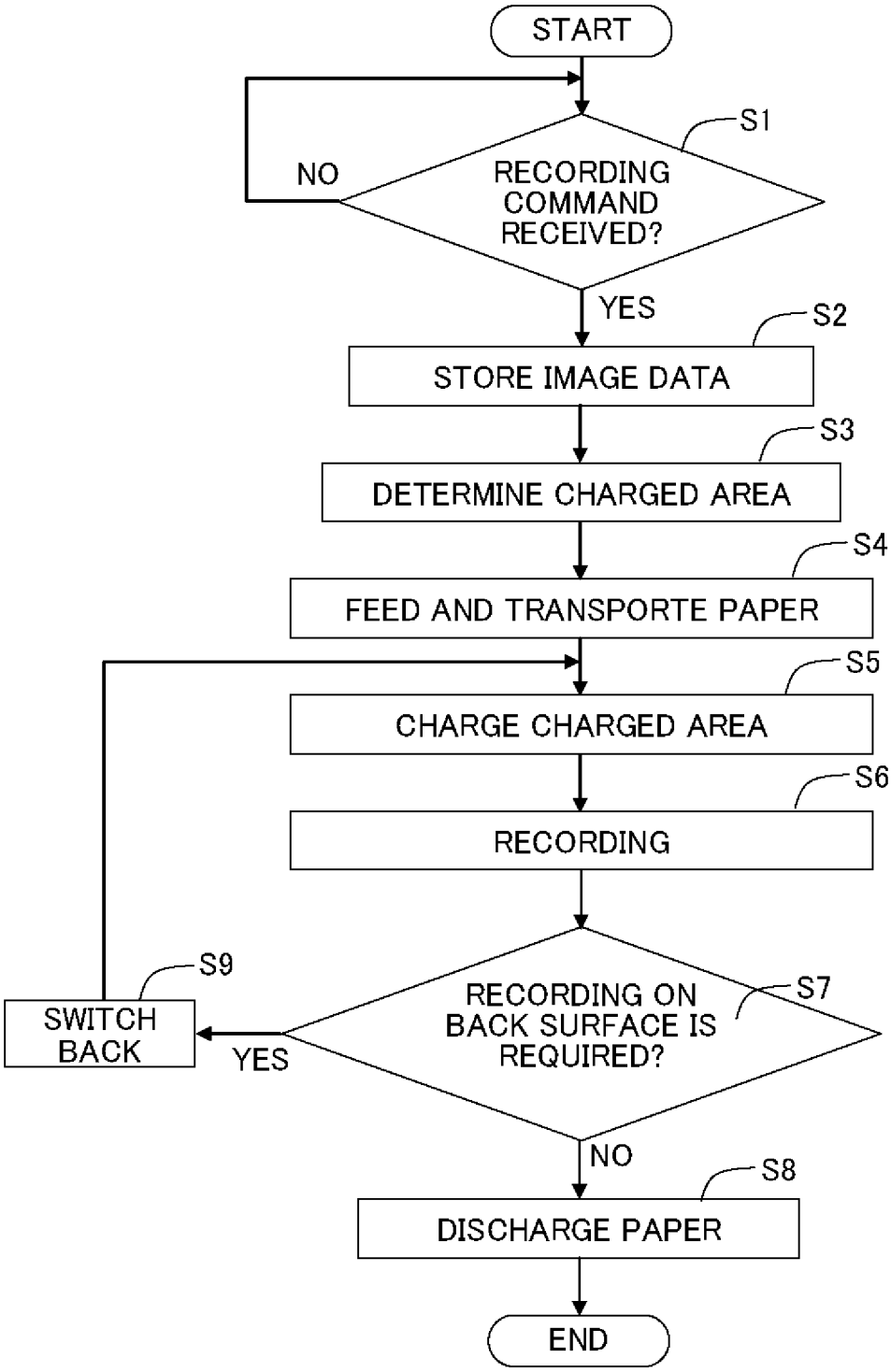
FIG. 7 is a flow diagram showing control contents executed by a controller of the printer.

Next, an explanation will be made about a method for determining the charged area E by the controller 1*p* and a method for controlling the charging section 40 with reference to FIG. 7 and FIG. 8.

The controller 1*p*, at first, judges as to whether or not a recording command is received from an external device such as a PC connected to the printer 1 (S1). In a case that the recording command is not received (S1: NO), a process is returned to S1 by the controller 1*p*. In a case that the recording command is received (S1: YES), the controller 1*p* stores information of image data included in the recording command in the RAM (S2).

After S2, the controller 1*p* determines the charged area E (S3). In this situation, an area of the paper sheet P on which ink, which is jetted from each of the jetting ports 14*a* when the paper sheet P is disposed on the facing area 10*y*, is not landed (hereinafter referred to as a "non-landing area") is determined as the charged area E by the controller 1*p*. This determination is performed by the CPU and information of the charged area E determined is stored in the RAM.

Figure 8A:
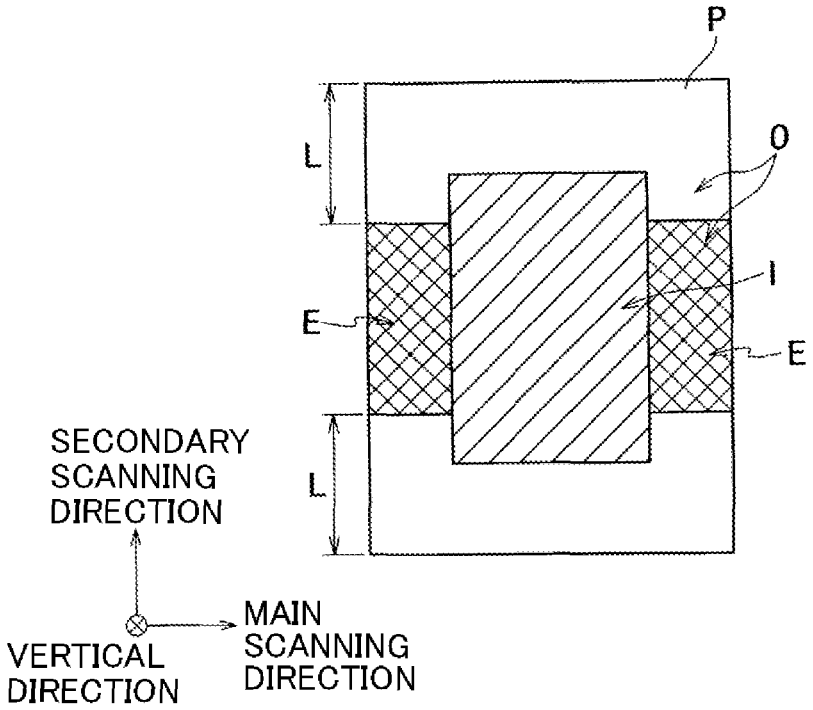
FIGS. 8A and 8B are illustrative views for illustrating methods for determining the charged area.
Figure 8B:
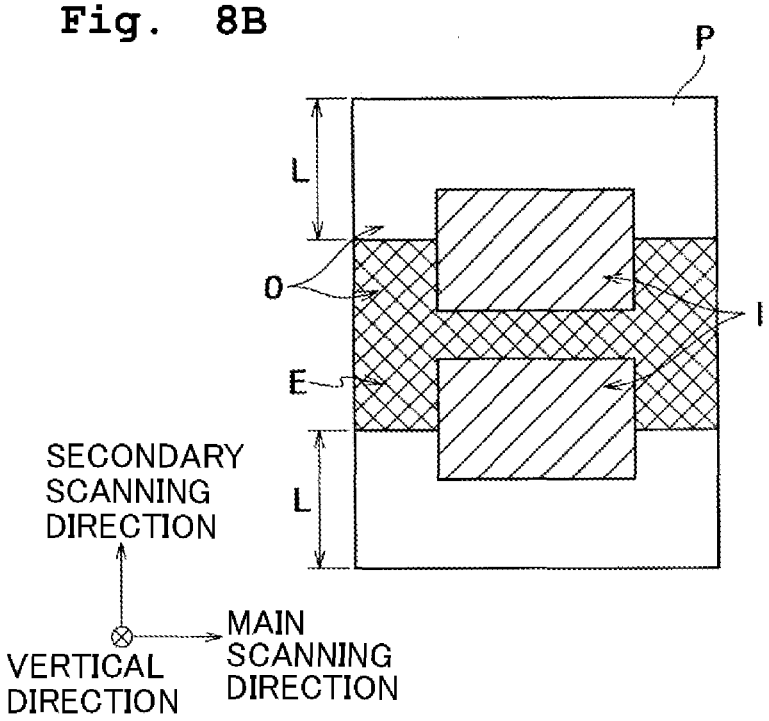

In S3, in particular, the controller 1*p* at first refers to the image data stored in the RAM to distinguish an image area I of the paper sheet P on which the image is to be recorded from a blank area O of the paper sheet P on which no image is recorded (see FIG. 8A and FIG. 8B). The blank area O is the non-landing area on which the ink, which is jetted from each of the jetting ports 14*a* when the paper sheet P is disposed on the facing area 10*y*, is not landed. It is allowable that a portion set as the blank or an area having no image to be recorded in the image data is identified as the blank area O. Next, an area, of the blank area O, which is positioned on the upstream side of the front end of the paper sheet P in the transport direction by not less than a distance L and is positioned on the downstream side of the rear end of the paper sheet P in the transport direction by not less than the distance L, is determined as the charged area E by the controller 1*p*. In other words, areas, of the blank area O, which are respectively away from the front end and the rear end of the paper sheet P in the transport direction by not less than the distance L, are determined as the charged areas E.

In an example of FIG. 8A, the image area I is positioned at the center portion in the paper sheet P and the blank area O is positioned to surround the image area I. The areas, of the blank area O, which are respectively away from the front end and the rear end of the paper sheet P in the transport direction by not less than the distance L, are determined as the charged areas E by the controller 1*p*. In this example, the charged areas E are end portions of the paper sheet P in a width direction (direction perpendicular to the transport direction: main scanning direction). In an example of FIG. 8B, there are two image areas I at portions of the paper sheet P other than the center portion, the front end, and the rear end. The blank area O surrounds the two image areas I. The area, of the blank area O, which are respectively away from the front end and the rear end of the paper sheet P in the transport direction by not less than the distance L, is determined as the charged areas E by the controller 1*p*. In this example, the charged area E includes the end portions of the paper sheet P in the width direction and the center portion of the paper sheet P.

In a case that the recording command received in S1 is a single-sided recording, the controller 1*p* determines, in S3, the charged area(s) E on the surface of the paper sheet P based on the image data to be recorded on the surface of the paper sheet P. In a case that the recording command received in S1 is a double-sided recording, the controller 1*p* determines, in S3, the charged area(s) E on the surface of the paper sheet P and the charged area(s) E on the back surface of the paper sheet P based on the image data to be recorded on the surface and the back surface of the paper sheet P. The controller 1*p* is an example of a charged-area determining section of the present teaching and the process in S3 executed by the controller 1*p* is an example of a process executed by the charged-area determining section of the present teaching.

After S3, the controller 1*p* controls the paper feed motor 1*c*M so that the paper sheet P is fed from the paper feed unit 1*c* and controls the transport section 20 so that the paper sheet P fed from the paper feed unit 1*c* is transported (S4).

After S4, the controller 1*p* controls the charging section 40 so that the charged area(s) E determined in S3 is charged (S5). In this situation, the controller 1*p* charges the charged areas E by the rollers 23*a* as shown in FIG. 5A as follows. That is, information of the charged area(s) E is read from the RAM, and the power sources 41 are individually controlled so that the voltage is applied to the roller(s) 23*a*, of the rollers 23*a*, making contact with the charged area(s) E and no voltage is applied to the roller(s) 23*a* which does not make contact with the charged area(s) E. In this situation, the controller 1*p* controls switch timing of the ON/OFF switch of each of the power sources 41 based on a detection signal from the paper sensor 32 and a measurement result of a rotary encoder 23E (see FIG. 6, an example of a measurement section) which measures rotation amounts of the rollers 23*a* and 23*b* of the pair of rollers 23. In particular, the controller 1*p* grasps a position of the paper sheet P in the transport pass based on a time elapsed after the paper sensor 32 detects the front end of the paper sheet P and the rotation amounts of the rollers 23*a* and 23*b*. The controller 1*p* controls the power sources 41 individually based on the position information of the paper sheet P grasped so that the charged area(s) E is charged.

After S5, the controller 1*p* controls the head 10 so that the image is recorded on the paper sheet P based on the image data stored in the RAM (S6). Here, the charged area(s) E is included in the blank area O and the image area I is not charged. After S6, the controller 1*p* judges as to whether or not the recording on the back surface of the paper sheet P is required by reference to the information included in the recording command received in S1 (S7). In a case that it is judged that the recording on the back surface is not required (S7: NO), the controller 1*p* controls the transport section 20 to discharge the paper sheet P on the paper discharge section 31 (S8). After S8, the controller 1*p* completes the process.

In a case that it is judged that the recording on the back surface is required (S7: YES), the controller 1*p* reverses the rotation direction of the pairs of rollers 26 and 27 when the paper sheet P is nipped by the pair of rollers 27 to perform switchback of the paper sheet P (S9). After S9, the controller 1*p* controls the charging section 40 so that the charged area(s) E on the back surface of the paper sheet P is charged (S5). After S5, the controller 1*p* controls the head 10 so that the image is recorded on the back surface of the paper sheet P (S6). After S6, since the recording on the back surface has already been performed, the controller 1*p* judges that the recording on the back surface is not required (S7: NO) and controls the transport section 20 to discharge the paper sheet P on the paper discharge section 31 (S8). After S8, the controller 1*p* completes the process.

As described above, according to this embodiment, the paper sheet P is used to remove the foreign matters in the casing 1*a* and it is unnecessary to provide any exclusive member to remove the foreign matters. Further, since the non-landing area of the paper sheet P on which no ink is landed is charged instead of charging any area of the paper sheet P, it is possible to suppress decrease in accuracy of landing of ink. By transporting the paper sheet P in a state of being charged, the foreign matters in the casing 1*a* are adsorbed to the charged area(s) E of the paper sheet P. Therefore, according to this embodiment, it is unnecessary to provide any exclusive member to remove the foreign matters and it is possible to remove the foreign matters in the casing 1*a* while suppressing the decrease in accuracy of landing of ink.

In this embodiment, an area, of the non-landing area, which is positioned between the pair of rollers 24 and the pair of rollers 25 when the paper sheet P is arranged in the facing area 10*y* is determined as the charged area(s) E by the controller 1*p*. In fact, area(s), of the non-landing area, other than the area as described above (for example, area(s) on the paper sheet P at the end portion on the downstream side and/or at the end portion on the upstream side in the transport direction) is supported in a cantilever manner by one of the pair of rollers 24 and the pair of rollers 25 in some cases. For example, the area on the paper sheet P at the end portion on the downstream side in the transport direction is supported in the cantilever manner by the pair of rollers 24 during a time after the rear end of the paper sheet P on the downstream side in the transport direction passes through the pair of rollers 24 and before the rear end of the paper sheet P on the downstream side in the transport direction arrives at the pair of rollers 25. The area of the paper sheet P at the end portion on the upstream side in the transport direction is supported in the cantilever shape by the pair of rollers 25 during a time after the rear end of the paper sheet P on the upstream side in the transport direction passes through the pair of rollers 24 and before the rear end of the paper sheet P on the upstream side in the transport direction arrives at the pair of rollers 25. In a case that the area(s) of the paper sheet P at the end portion(s) on the downstream side and/or the upstream side in the transport direction is charged in the above state, the area(s) may make contact with the jetting surface 10*x*. Especially, in a case that the jetting surface 10*x* is grounded, the phenomenon as described above is more likely to occur. In a case that the area(s) makes contact with the jetting surface 10*x*, the foreign matters adhere to the jetting ports 14*a* and jetting failure may arise. In this embodiment, however, by determining the area, of the non-landing area, which is positioned between the pair of rollers 24 and the pair of rollers 25 as the charged area E, it is possible to reduce the problem as described above. In other words, even when the area tries to make contact with the jetting surface 10*x*, the area is less likely to make contact with the jetting surface 10*x*, because the paper sheet P is nipped by the pair of rollers 24 and the pair of rollers 25.

Further, the end portion(s) of the paper sheet P in the width direction, which is included in the non-landing area, is determined as the charged area(s) E by the controller 1*p*. The foreign matters are more likely to adhere to the end portion(s) of the paper sheet P in the width direction. Then, by charging the end portion(s) as described above, the foreign matters adhering to the end portion(s) are adsorbed and thereby making it possible to suppress scatter of the foreign matters in the casing 1*a*.

The controller 1*p* charges the charged area(s) E as follows. That is, the plurality of power sources 41 are controlled individually so that the voltage is applied to the roller(s) 23*a*, of the plurality of rollers 23*a*, which makes contact with the charged area(s) E and the voltage is not applied to the roller(s) 23*a* which does not make contact with the charged area(s) E. In the above configuration, since the power sources 41 are controlled individually, it is possible to reliably charge the charged area(s) E determined such as only the end portion(s) of the paper sheet P in the width direction.

In a case that the double-sided printing is performed and that the ink is jetted onto the back surface in a state that the foreign matters are adhered to the back surface of the paper sheet P, recording quality on the back surface is deteriorated. In this embodiment, it is possible to reduce this problem by providing the foreign substance elimination section 50. Further, by performing electricity removal of the paper sheet P before the recording on the back surface of the paper sheet P and by charging the charged area(s) E on the back surface of the paper sheet P, it is possible to remove the foreign matters in the casing 1*a* more reliably while suppressing the decrease in accuracy of landing of ink.

The foreign substance elimination section 50 includes the grounded roller 26*b*. The grounded roller 26*b* is brought in contact with the back surface of the paper sheet P to remove the foreign matters adhering to the back surface of the paper sheet P. In this case, the charge amount of the foreign matters adsorbing to the surface and the back surface of the paper sheet P is reduced, and thereby the foreign matters are more likely to be separated from the back surface. Therefore, in this embodiment, it is possible to remove the foreign matters adhering to the back surface of the paper sheet P by a relatively simple construction.

The plurality of bumps 7*p* are formed in the support surface 7*x* of the platen 7. At least the front end portions 7*p*1, of the bumps 7*p*, which make contact with the paper sheet P, are made of the conductive material. A non-conductive material tends to have a large charge amount by friction as compared with the conductive material. Therefore, in a case that the front end portions 7*p*1 are made of the non-conductive material, larger electrical charge is generated in the front end portions 7*p*1 by friction between the paper sheet P and the front end portions 7*p*1 at the time of transporting the paper sheet P, and thereby the foreign matters are more likely to adhere to the front end portions 7*p*1. In a case that the following paper sheet P is transported to make contact with the front end portions 7*p*1 in a state that the foreign matters are adhered to the front end portions 7*p*1, the foreign matters adhering to the front end portions 7*p*1 are scattered in the casing 1*a*, and further the foreign matters may adhere to the jetting ports 14*a* to cause the jetting failure. In this embodiment, however, even when the friction between the paper sheet P and the front end portions 7*p*1 is occurred at the time of transporting the paper sheet P, large electrical charge is less likely to be generated in the front end portions 7*p*1, because the front end portions 7*p*1 are made of the conductive material. Therefore, it is possible to reduce the above problem.

Subsequently, an explanation will be made about an ink-jet printer 201 according to the second embodiment of the present teaching with reference to FIG. 9 and FIG. 10.

The structures of the charging section and the foreign substance elimination section in the printer 201 of the second embodiment are different from those in the printer 1 of the first embodiment. Other structures in the printer 201 are the same as those in the printer 1 of the first embodiment.

Figure 9:
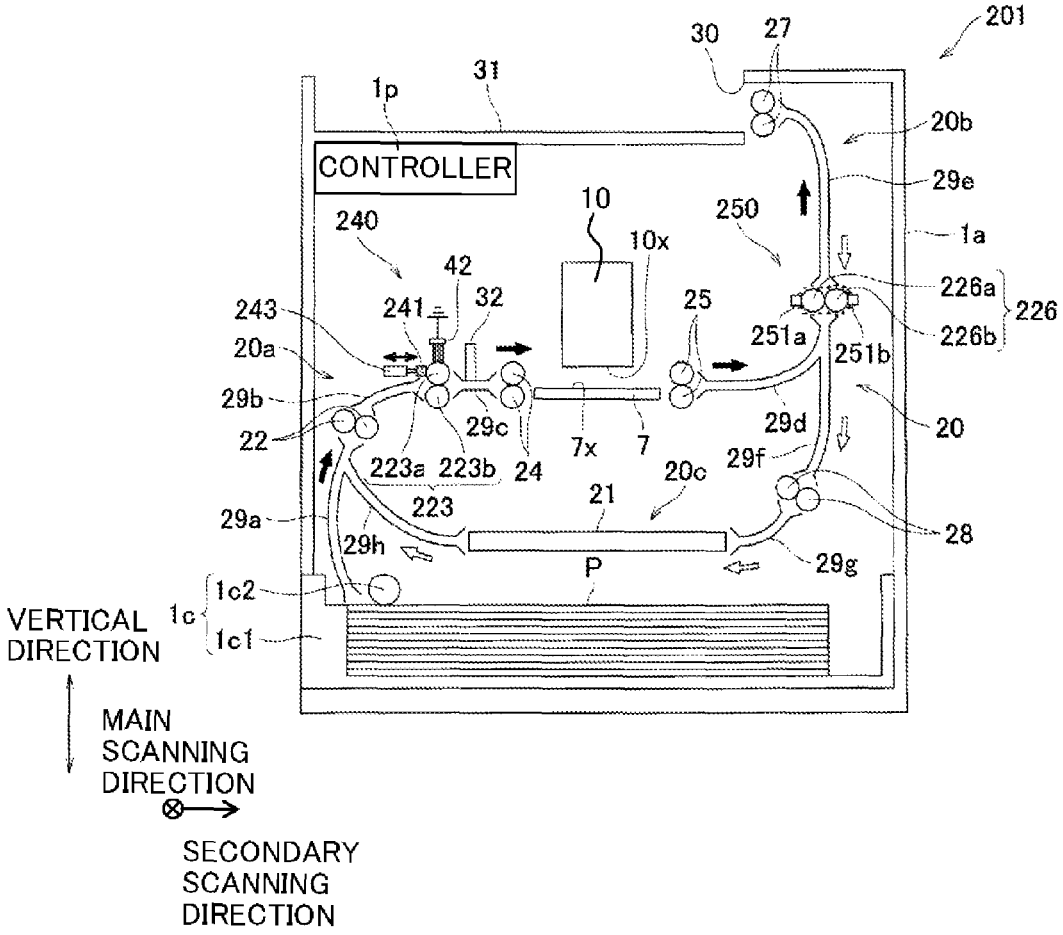
FIG. 9 is a schematic side view showing an internal structure of an ink-jet printer according to the second embodiment of the present teaching.

In the second embodiment, a charging section 240 is constructed of a pair of rollers 223, a sponge 241 (an example of the voltage applying section and a contact-separation member), a solenoid 243 (an example of the contact-separation mechanism), and the electricity removal brush 42 as shown in FIG. 9.

The pair of rollers 223 includes rollers 223*a* and 223*b*. Although illustrations are omitted in FIG. 9 and FIG. 10, a plurality of rollers 223*a* (an example of the charging member, the contact member and the rotating member) are provided similar to the rollers 23*a* in the first embodiment (see FIG. 5A), and the plurality of rollers 223*a* are arranged to be separated from each other in the direction perpendicular to the transport direction (main scanning direction). The rollers 223*a* are attached to a rotational axis 223*a*1 extending in the main scanning direction as shown in FIG. 10. The roller 223*b* extends in the main scanning direction to make contact with all of the rollers 223*a* and is grounded, similar to the roller 23*b* in the first embodiment. The length of the roller 223*b* in the main scanning direction is longer than the width of the paper sheet P, and has a length substantially the same as the total length of the rollers 223*a* in the main scanning direction. The rollers 223*a* and 223*b* rotate in directions different from each other with an axis along the main scanning direction as a rotation center while nipping the paper sheet P (see FIG. 10). Accordingly, the paper sheet P is transported in the transport direction.

Figure 10:
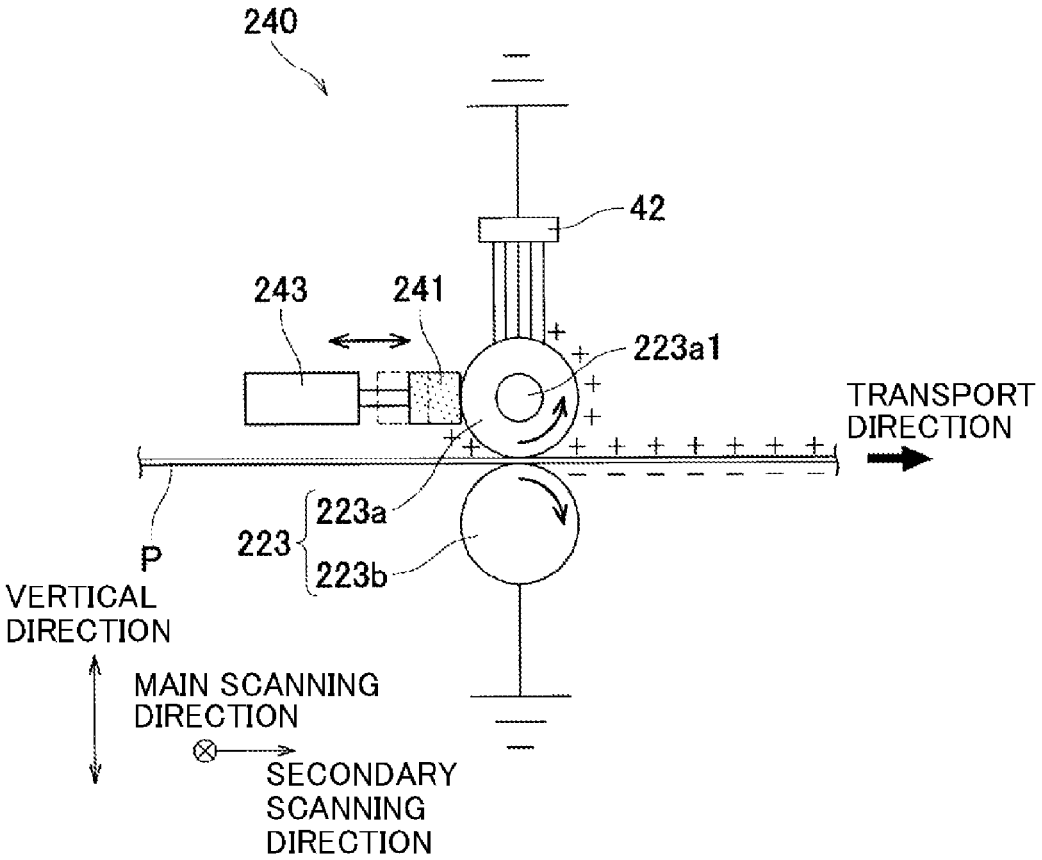
FIG. 10 schematically shows a charged aspect of the paper sheet by a charging section shown in FIG. 9.

The sponge 241 is provided for each roller 223*a*, and may be arranged at a contact position at which the sponge 241 makes contact with the outer circumferential surface of each roller 223*a* (position depicted by solid line in FIG. 10) and at a separate position at which the sponge 241 is separated from the outer circumferential surface of each roller 223*a* (position depicted by broken line in FIG. 10). The sponge 241 charges each roller 223*a* by friction against the outer circumferential surface of each roller 223*a* when the sponge 241 is positioned at the contact position. Each of the sponges 241 is formed of a material such as urethane foam.

The solenoid 243 is provided for each sponge 241. The sponge 241 is fixed to the front end of each plunger. The solenoid 243 is driven by control of the controller 1*p*, and the sponge 241 is moved to the contact position and the separate position by expansion and contraction of each plunger. In a case that the sponge 241 is positioned at the contact position and that the corresponding roller 223*a* rotates, a portion of the outer circumferential surface of the roller 223*a* which has passed through the sponge 241 is charged. Then, in a case that the roller 223*a* further rotates and that the charged portion of the outer circumferential surface of the roller 223*a* arrives at the electricity removal brush 42, the electrical charge on the outer circumferential surface of the roller 223*a* is removed.

In a case that the sponge 241 is positioned at the contact position when the pair of rollers 223 transports the paper sheet P while nipping the paper sheet P, the portion of the corresponding roller 223*a* charged by the sponge 241 makes contact with the paper sheet P. Accordingly, the portion of the paper sheet P which makes contact with the roller 223*a* is charged. In this situation, the positive electrical charge is generated on the surface, of the paper sheet P, which makes contact with the roller(s) 223*a* and the negative electrical charge is generated on the surface, of the paper sheet P, on the side opposite to the surface making contact with the roller(s) 223*a* (see FIG. 10). By transporting the paper sheet P in a state of being charged as described above, the foreign matters in the casing 1*a* is adsorbed to the charged area(s) E of the paper sheet P.

The controller 1*p* controls the charging section 240 to charge the charged area(s) E. In particular, the controller 1*p* charges the charged area(s) E as follows. That is, the information of the charged area(s) E is read from the RAM, and the plurality of solenoids 243 are controlled individually so that the roller(s) 223*a*, of the plurality of rollers 223*a*, which makes contact with the charged area(s) E is charged and that the roller(s) 223*a* which does not make contact with the charged area(s) E is not charged. In this situation, the controller 1*p* controls timing of each of the sponges 241 to make contact with or separation from one of the rollers 223*a* based on a detection signal from the paper sensor 32 and a measurement result of the rotary encoder 23E (see FIG. 6) which measures rotation amounts of the rollers 223*a* and 223*b* of the pair of rollers 223. Specifically, the controller 1*p* grasps a position of the paper sheet P in the transport pass based on a time elapsed after the paper sensor 32 detects the front end of the paper sheet P and the rotation amounts of the rollers 223*a* and 223*b*. The controller 1*p* controls the solenoids 243 individually based on the position information of the paper sheet P grasped so that the charged area(s) E is charged.

In the second embodiment, a foreign substance elimination section 250 is constructed of a pair of rollers 226 (an example of the opposite electric charging member) and cleaners 251*a* and 251*b* (examples of a cleaning member) as shown in FIG. 9.

The pair of rollers 226 includes rollers 226*a* and 226*b* (an example of a third roller). Although illustrations are omitted in FIG. 9, a plurality of rollers 226*a* and a plurality of rollers 226*b* are provided similar to the rollers 23*a* in the first embodiment (see FIG. 5A), and the plurality of rollers 226*a* and 226*b* are respectively arranged to be separated from each other in the direction perpendicular to the transport direction (main scanning direction). Each of the rollers 226*a* is charged with the negative electrical charge and each of the rollers 226*b* is charged with the positive electrical charge. That is, each of the rollers 226*a* and 226*b* is charged with a polarity which is opposite to that of the paper sheet P charged by the charging section 40. The rollers 226*a* and 226*b* rotate in directions different from each other with axes along the main scanning direction as rotation centers while nipping the paper sheet P. Accordingly, the paper sheet P is transported in the transport direction.

In a case that each of the rollers 226*a* and 226*b* makes contact with the surface and the back surface of the paper sheet P in a state that the paper sheet P is nipped by the pair of rollers 226, the electrical charge on the surface and the back surface of the paper sheet P is reduced. In particular, each roller 226*a*, which is charged with a polarity which is opposite to that of the surface of the paper sheet P, makes contact with the surface of the paper sheet P and each roller 226*b*, which is charged with a polarity which is opposite to that of the back surface of the paper sheet P, makes contact with the back surface of the paper sheet P. Accordingly, the electrical charge on the surface and the back surface of the paper sheet P is reduced. Further, the foreign matters adhering to the paper sheet P are adsorbed to the rollers 226*a* and 226*b* to be removed from the paper sheet P.

It is noted that in a case that the charged rollers 226*a* and 226*b* make contact with an entire area of the paper sheet P, area(s) other than the area(s) corresponding to the charged area(s) E, on a surface, of the paper sheet P, which makes contact with each roller 226*b* (back surface of the paper sheet P on which recording is performed after transport by the re-transport section 20*c* in the double-sided printing) is charged, which may cause the decrease in accuracy of landing of ink at the time of the recording on the back surface. In view of this, in the second embodiment, the rollers 226 and 226*b* are controlled individually as follows. That is, power sources, each of which incorporates the same ON/OFF switch as that of each of the power sources 41 in the first embodiment, are connected to the respective rollers 226*a* and 226*b* individually. Switching of the ON/OFF switch of each of the power sources is performed by control of the controller 1*p*. In other words, the power sources connected to the rollers 226*a* and 226*b* facing the charged area(s) E are switched on and the power sources connected to the rollers 226*b* facing the area other than the charged area(s) E are switched off. In a case that the power sources are switched on, the rollers 226*a* and 226*b* are charged. In a case that the power sources are switched off, the rollers 226*a* and 226*b* are not charged. Accordingly, the electrical charge in the area(s) corresponding to the charged area(s) E is reduced without charging the area, of the back surface of the paper sheet P, other than the area(s) corresponding to the charged area(s) E.

Each of the cleaners 251*a* and 251*b* is a member which cleans each of the rollers 226*a* and 226*b*. The cleaners 251*a* and 251*b* are arranged at positions at which the cleaners 251*a* and 251*b* make contact with the rollers 226*a* and 226*b* respectively. The cleaners 251*a* and 251*b* are formed of a sponge member and the like. There may be further provided a box in which the foreign matters removed by the cleaners 251*a* and 251*b* are kept, an auger member disposed in the box, a storage section in which the foreign matters transported by the auger member are stored, and the like.

As described above, according to the second embodiment, the controller 1*p* charges the charged area(s) E by controlling the solenoids 243 individually to move the sponges 241 individually. In this configuration, by performing the control individually, it is possible to reliably charge the determined charged area(s) E such as only the end portion(s) of the paper sheet P in the width direction.

The foreign substance elimination section 250 includes the rollers 226*a* and 226*b*, each of which is charged with a polarity opposite to that of the paper sheet P charged by the charging section 240. By bringing each roller 226*b* into contact with the area corresponding to the charged area E of the back surface of the paper sheet P, the foreign matters are adsorbed to each roller 226*b* to be removed from the paper sheet P. According to the second embodiment, it is possible to reliably remove the foreign matters adhering to the back surface of the paper sheet P by adsorption action.

The foreign substance elimination section 250 further includes the cleaners 251*a* and 251*b* which clean the rollers 226*a* and 226*b* respectively. In this configuration, it is possible maintain the adsorption action by the rollers 226*a* and 226*b*.

Subsequently, an explanation will be made about an ink-jet printer 301 according to the third embodiment of the present teaching with reference to FIG. 11 and FIGS. 12A and 12B.

The structure of the charging section in the printer 301 of the third embodiment is different from that of the printer 1 of the first embodiment. Other structures in the printer 301 are the same as those in the printer 1 of the first embodiment.

Figure 11:
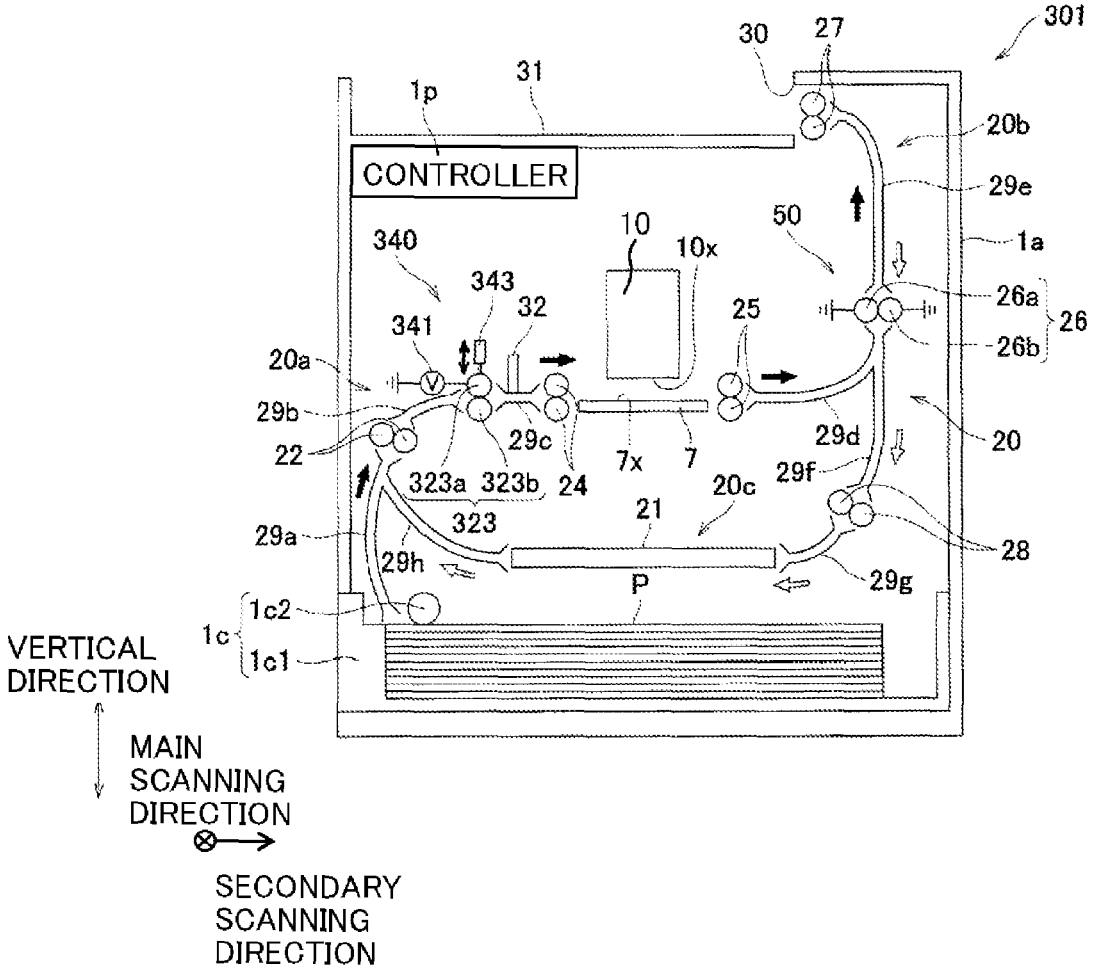
FIG. 11 is a schematic side view showing an internal structure of an ink-jet printer according to the third embodiment of the present teaching.

In the third embodiment, a charging section 340 is constructed of a pair of rollers 323, a power source 341 (an example of the voltage applying section), and a solenoid 343 (an example of the movement mechanism) as shown in FIG. 11.

The pair of rollers 323 includes rollers 323*a* (an example of the charging member, the contact member and the second roller) and a roller 323*b* (an example of the first roller). As shown in FIG. 12A, a plurality of rollers 323*a* are provided similar to the rollers 23*a* in the first embodiment (see FIG. 5A), and the plurality of rollers 323*a* are arranged to be separated from each other in the direction perpendicular to the transport direction (main scanning direction). Unlike the rollers 23*a* in the first embodiment, the plurality of rollers 323*a* are attached to a plurality of rotational axes 323*a*1 individually. The rotational axes 323*a*1 each extend in the main scanning direction and are arranged to be separated from each other in the main scanning direction. Similar to the roller 23*b* in the first embodiment, the roller 323*b* extends in the main scanning direction to make contact with all of the rollers 323*a*, and the roller 323*b* is grounded. The length of the roller 323*b* in the main scanning direction is longer than the width of the paper sheet P and is substantially the same as the total length of the rollers 323*a* in the main scanning direction. The rollers 323*a*, 323*b* rotate in directions different from each other with axes along the main scanning direction as rotation centers, while nipping the paper sheet P. Accordingly, the paper sheet P is transported in the transport direction.

Figure 12A:
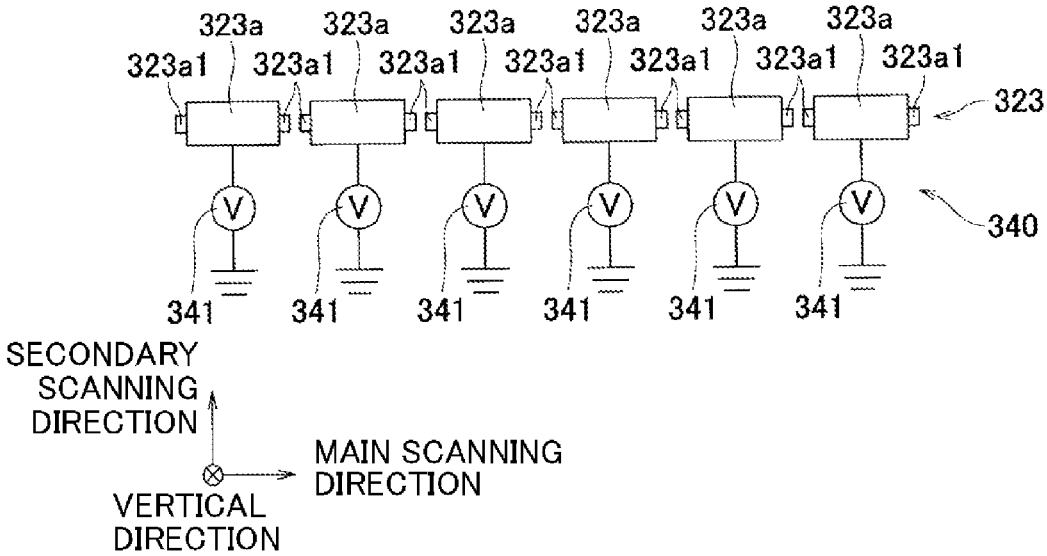
FIG. 12A is a plan view for explaining a structure of a charging section shown in FIG. 11.

As shown in FIG. 12A, each of the power sources 341 is provided for one of the rollers 323*a* similar to each of the power sources 41 in the first embodiment (see FIG. 5A). Each of the power sources 341 applies the voltage to one of the rollers 323*a* to charge the one of the rollers 323*a*. A positive terminal of each of the power sources 341 is connected to one of the rollers 323*a* and a negative terminal of each of the power sources 341 is grounded. Each of the power sources 341 may not incorporate the ON/OFF switch.

Figure 12B:
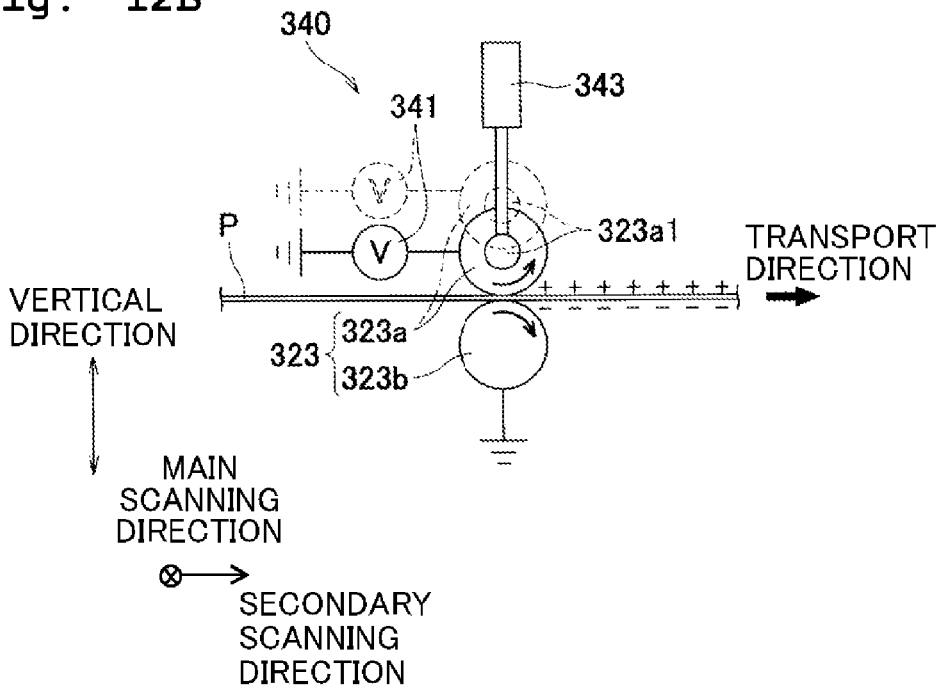
FIG. 12B schematically shows a charged aspect of the paper sheet by the charging section shown in FIG. 11.

The solenoid 343 is provided for each roller 323*a* as shown in FIG. 12B. The rotational axis 323*a*1 is fixed to the front end of each plunger. The solenoid 343 is driven by control of the controller 1*p*, and the corresponding roller 323*a* is moved in an up-down direction by expansion and contraction of each plunger. Accordingly, the roller 323*a* may be arranged at a nipping position at which the paper sheet P is nipped between the roller 323*a* and the roller 323*b* (position depicted by solid line in FIG. 12B) and at a non-nipping position at which the roller 323*a* is separated from the roller 323*b* and the paper sheet P is not nipped between the roller 323*a* and the roller 323*b* (position depicted by broken line in FIG. 12B).

In a case that each of the rollers 323*a* is charged when the paper sheet P is nipped by the pair of rollers 323, a portion of the paper sheet P which makes contact with each of the rollers 323*a* is charged. In this situation, the positive electrical charge is generated on the surface, of the paper sheet P, which makes contact with each roller 323*a* and the negative electrical charge is generated on the surface, of the paper sheet P, on the side opposite to the surface making contact with each roller 323*a*. By transporting the paper sheet P in a state of being charged as described above, the foreign matters in the casing 1*a* are adsorbed to the charged area E of the paper sheet P.

The controller 1*p* controls the charging section 340 to charge the charged area E. In particular, the controller 1*p* charges the charged area(s) E as follows. That is, information of the charged area(s) E is read from the RAM and the plurality of rollers 323*a* are moved individually by controlling the solenoids 343 individually so that the roller(s) 323*a*, of the plurality of the rollers 323*a*, which makes contact with the charged area(s) E is positioned at the nipping position and the roller(s) 323*a*, of the plurality of the rollers 323*a*, which does not make contact with the charged area(s) E is positioned at the non-nipping position. In this situation, the controller 1*p* controls timing of movement of each of the rollers 323*a* based on a detection signal from the paper sensor 32 and a measurement result of the rotary encoder 23E (see FIG. 6) which measures rotation amounts of the rollers 323*a* and 323*b* of the pair of rollers 323. In particular, the controller 1*p* grasps a position of the paper sheet P in the transport pass based on a time elapsed after the paper sensor 32 detects the front end of the paper sheet P and the rotation amounts of the rollers 323*a* and 323*b*. The controller 1*p* controls the solenoids 343 individually based on the position information of the paper sheet P grasped so that the charged area(s) E is charged.

As described above, according to the third embodiment, the controller 1*p* charges the charged area(s) E as follows. That is, the plurality of rollers 323*a* are moved individually by controlling the solenoids 343 individually so that the roller(s) 323*a*, of the plurality of the rollers 323*a*, which makes contact with the charged area(s) E is positioned at the nipping position and the roller(s) 323*a*, of the plurality of the rollers 323*a*, which does not make contact with the charged area(s) E is positioned at the non-nipping position. In this configuration, by performing the control individually, it is possible to reliably charge the determined charged area(s) E such as only the end portion(s) of the paper sheet P in the width direction.

Hereinabove, the explanation was made with respect to the preferred embodiments of the present teaching. However, the present teaching is not limited to the above embodiments, but allows various changes in design in so far as in accordance with the accompanying claims.

In the second embodiment, the electrical charge of the rollers 226*a* and 226*b* may not be controlled by switching the ON/OFF switches of the power sources, but the rollers 226*a* and 226*b* may make contact with or separation from the paper sheet P by moving the rollers 226*a* and 226*b* in a similar manner as the rollers 323*a* in the third embodiment. Also in this case, it is possible to reduce the electrical charge of the area(s) corresponding to the charged area(s) E without charging the area, of the back surface of the paper sheet P, other than the area(s) corresponding to the charged area(s) E. Further, the plurality of the rollers 226*a* and 226*b* may be arranged to be elongated in the direction perpendicular to the transport direction without being limited to the arrangement in which the plurality of the rollers 226*a* and 226*b* are arranged to be separated from each other in the direction perpendicular to the transport direction.

In the third embodiment, the sponge 241 in the second embodiment may be used instead of the power source 341 as a means for charging the roller 323*a*.

The rollers 23*a* in the charging section 40, the rollers 223*a* in the charging section 240, and the rollers 323*a* in the charging section 340 may be respectively arranged to be elongated in the direction perpendicular to the transport direction without being limited to the arrangement in which the rollers 23*a* in the charging section 40, the rollers 223*a* in the charging section 240, and the rollers 323*a* in the charging section 340 are respectively arranged to be separated from each other in the direction perpendicular to the transport direction.

In the above embodiments, the area, of the non-landing area, which is positioned between the pair of rollers on the upstream side and the pair of rollers on the downstream side when the recording medium is arranged in the facing area 10*y*, and the end portion(s) in the direction perpendicular to the transport direction are determined as the charged areas E. However, it is allowable that only the end portion(s) in the direction perpendicular to the transport direction is determined as the charged area(s) E and that any area, of the non-landing area, which is other than the areas as described above is determined as the charged area(s) E. Further, the end portion(s) in the direction perpendicular to the transport direction is exemplified by both ends of the paper sheet P in the width direction in the above embodiments. However, the end portion(s) in the direction perpendicular to the transport direction may be only one end of the paper sheet P in the width direction, or the entire blank area O may be determined as the charged area E. In the above embodiments, in a case that the recording command requires to perform the double-sided recording, the charged area(s) E in the surface of the paper sheet P and the charged area(s) E in the back surface of the paper sheet P are determined based on image data to be recorded on the surface and the back surface of the paper sheet P. The present teaching, however, is not limited thereto. For example, the charged area(s) E may be determined based on the blank area O which is common to both of the surface and the back surface of the paper sheet P.

It is only necessary for the foreign substance elimination section to remove the foreign substance adhering to at least the second surface (back surface) in the paper sheet P, and the foreign substance elimination section may not remove the foreign matters adhering to the first surface (surface). The structure of the foreign substance elimination section is not limited to inclusion the ground member and the opposite electric charging member, provided that the foreign substance elimination section is capable of removing the foreign matters adhering to at least the second surface in the paper sheet P. The foreign substance elimination section may have any structure (for example, structure to wipe the foreign matters adhering to the second surface by a wiper and the like). The material of the cleaners 251*a*, 251*b* is not limited to the sponge member and the like provided that the cleaners 251*a*, 251*b* are capable of cleaning the pair of rollers 226. The cleaners 251*a*, 251*b* may have any structure (for example, structure to remove the foreign matters adhering to the pair of rollers 226 by an adhesive member having an adhesive layer formed on the surface thereof). The cleaners 251*a*, 251*b* may be omitted.

It is allowable that the transport section 20 does not include the re-transport section 20*c* and includes only the upstream transport section 20*a* and the downstream transport section 20*b*. In this case, the foreign substance elimination sections 50, 250 may be omitted. Further, the type of the transport section 20 is not limited to a roller transport type as in the above embodiments. For example, the type of the transport section 20 may be a belt transport type.

The extending direction of each of the bumps 7*p* of the platen 7 is not limited to the transport direction. Each of the bumps 7*p* may extend in a direction intersecting the transport direction. Further, each of the bumps 7*p* may be scattered on the surface 7*x* of the platen 7 instead of extending in the transport direction or the direction intersecting the transport direction. The number of bumps 7*p* formed on the surface 7*x* is an arbitrary number. A portion, of each bump 7*p*, other than the portion making contact with the paper sheet P (for example, side surface(s) of each bump) may be formed of a material other than the conductive material. Further, the portion, of each bump 7*p*, other than the portion making contact with the paper sheet P (for example, the entire support member) may be also formed of the conductive material. Each bump 7*p* may not be formed on the surface 7*x* of the platen 7.

The number of jetting sections included in the liquid jetting apparatus may be an arbitrary number not less than one. Further, any liquid other than the ink may be jetted from the jetting sections.

The recording medium is not limited to the paper sheet P, and may be any medium for which the recording can be performed.

The present teaching may be applicable to a facsimile, a copying machine, and the like without being limited to the printer.

What is claimed is:

1. A liquid jetting apparatus configured to jet a liquid on a recording medium, comprising:

a jetting section comprising a plurality of jetting ports for jetting the liquid;

a transport section configured to transport the recording medium along a transport pass having a facing area which faces the plurality of jetting ports, wherein the transport section includes a pair of rollers on an upstream side, which is arranged on the upstream side of the facing area in a transport direction and configured to nip the recording medium, and a pair of rollers on a downstream side, which is arranged on a downstream side of the facing area in the transport direction at a position separated from the pair of rollers on the upstream side by a distance shorter than a length of the recording medium in the transport direction and configured to nip the recording medium;

a charging section arranged on the upstream side of the facing area in the transport direction in which the recording medium is transported by the transport section, and configured to charge the recording medium;

a charged-area determining section configured to determine an area, of the non-landing area, which is positioned between the pair of rollers on the upstream side and the pair of rollers on the downstream side in a case that the recording medium is disposed at the facing area, as a charged area; and a controller configured to control the charging section to charge the charged area determined by the charged-area determining section.

2. The liquid jetting apparatus according to claim 1, wherein the charged-area determining section is configured to determine an end portion, of the non-landing area, in a direction perpendicular to the transport direction, as the charged area.

3. A liquid jetting apparatus configured to jet a liquid on a recording medium, comprising:

a jetting section comprising a plurality of jetting ports for jetting the liquid;

a transport section configured to transport the recording medium along a transport pass having a facing area which faces the plurality of jetting ports, wherein the transport section includes a pair of rollers on an upstream side, which is arranged on the upstream side of the facing area in a transport direction and configured to nip the recording medium, and a pair of rollers on a downstream side, which is arranged on a downstream side of the facing area in the transport direction at a position separated from the pair of rollers on the upstream side by a distance shorter than a length of the recording medium in the transport direction and configured to nip the recording medium;

a charging section arranged on the upstream side of the facing area in the transport direction in which the recording medium is transported by the transport section, and configured to charge the recording medium; and a controller configured to determine an area, of the non-landing area, which is positioned between the pair of rollers on the upstream side and the pair of rollers on the downstream side in a case that the recording medium is disposed at the facing area, as a charged area, and to control the charging section to charge the charged area determined.

* * * * *